United States Patent [19]

Sornberger

[11] 4,199,174

[45] Apr. 22, 1980

[54] CARBONLESS MANIFOLD BUSINESS FORMS

[75] Inventor: G. Russell Sornberger, Sanborn, N.Y.

[73] Assignee: Moore Business Forms, Inc., Grand Island, N.Y.

[21] Appl. No.: 957,580

[22] Filed: Nov. 3, 1978

Related U.S. Application Data

[63] Continuation of Ser. No. 686,100, May 13, 1976, abandoned.

[51] Int. Cl.[2] ..... B41L 1/36

[52] U.S. Cl. ..... 282/27.5; 428/307

[58] Field of Search ..... 282/27.5, 28 A, 23 R, 282/22 R, 26, 27 R; 428/307

[56] References Cited

U.S. PATENT DOCUMENTS

| | | | |
|---|---|---|---|
| 2,712,507 | 7/1955 | Green | 428/307 |
| 2,870,040 | 1/1959 | Gill, Jr. | 282/28 R |
| 3,147,991 | 9/1964 | Heinz, Sr. | 282/23 R |
| 3,170,719 | 2/1965 | Kraus | 282/23 R |
| 3,290,061 | 12/1966 | Glassman | 282/23 R |
| 3,481,759 | 12/1969 | Ostlie | 282/28 R |

FOREIGN PATENT DOCUMENTS

| | | | |
|---|---|---|---|
| 799027 | 7/1958 | United Kingdom | 282/11.5 A |

*Primary Examiner*—John McQuade

*Attorney, Agent, or Firm*—Watson, Cole, Grindle & Watson

[57] ABSTRACT

A set of manifold business forms includes at least three plies having selected mating surfaces thereof coated with chemicals which are capable of reacting with one another to produce a colored mark. An intermediate ply of the set is of tissue material having its back surface coated with a color precursor in the form of a microencapsulated liquid, and the bottom ply of the set is of an opaque material having its front surface coated with a composition of a generally solid record-developing material. The top ply of the set is likewise of an opaque material so that, upon the application of pressure to the set, an image thereof is developed on the top surface of the bottom ply. The use of a coated-back tissue avoids capsular damage during the printing operation of the forms since all that is printed is a coated front sheet.

2 Claims, 3 Drawing Figures

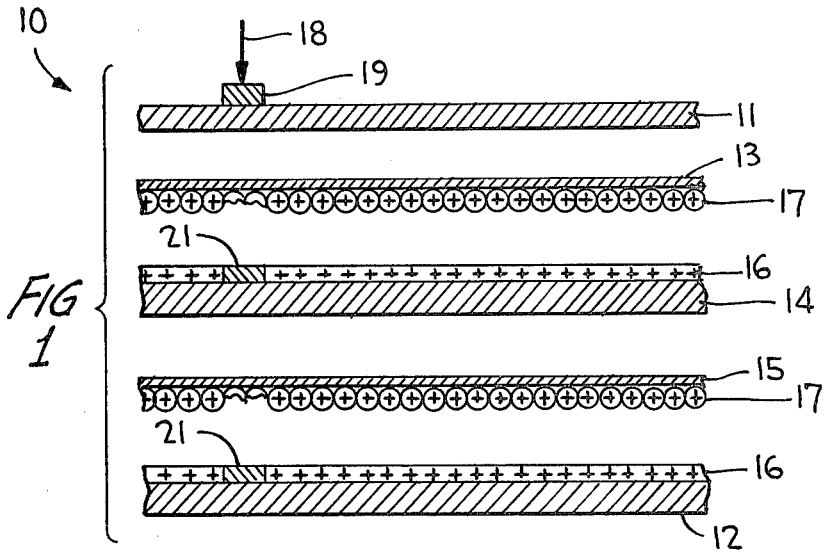
FIG 1
FIG. 2
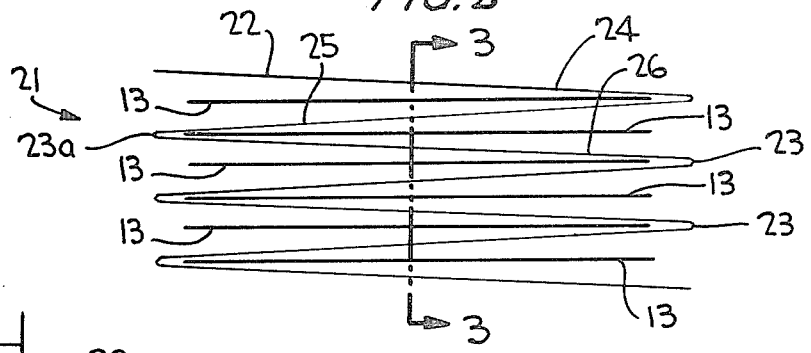
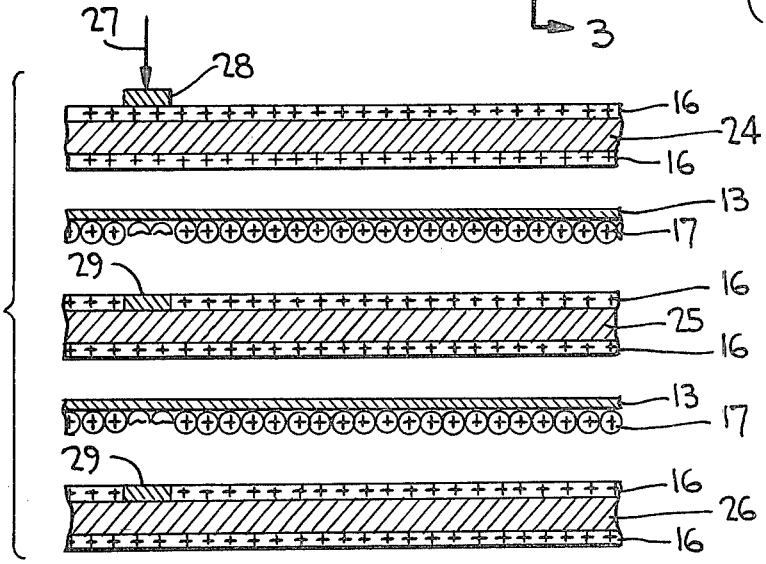
FIG. 3

CARBONLESS MANIFOLD BUSINESS FORMS

This is a continuation of application Ser. No. 686,100 filed May 13, 1976, now abandoned.

BACKGROUND OF THE INVENTION

This invention relates generally to a carbonless copying system wherein the mating sheet surfaces are coated respectively with compatible initially colorless reactive components capable of reacting to produce a colored mark upon impact. More particularly, the invention relates to manifolded sets utilizing an initially colorless color forming system including an intermediate tissue ply or plies which are unprinted.

Manifolded sets of carbonless copying paper typically comprise three sheets with the top sheet thereof coated on its back surface with an encapsulated solution of a colorless color-former in a suitable solvent, the bottom sheet having its front surface coated (CF) with a solid material containing a record-developing material, and the intermediate sheet being coated front and back (CFB) respectively with the above mentioned solid record-developing material and with the color precursor. Such back coatings (CB) normally comprise pressure rupturable microcapsules containing a fluid color precursor in fluid form which is capable of reacting to thereby form a colored compound with the developing material in the front coating of the next adjacent sheet so that, upon impact by a machine key or application of pressure by a stylus on the top sheet, the contents of the ruptured capsules in the back coatings spill out and react with the developing material to form a colored mark on the latter which corresponds to the mark impressed by the stylus or machine key.

U.S. Pat. Nos. 2,712,507 and 3,016,308 illustrate the most common variety of carbonless impact transfer paper of the type with which the present invention is primarily concerned wherein microcapsules containing a liquid fill comprising a chemically reactive color-forming precursor are coated on the back surface of the sheet, and a dry coating of a solid co-reactant chemical for the precursor is coated on the front surface of a receiving sheet.

The pressure sensitivity of the present chemical transfer papers of the aforementioned type presents a problem in finding a balance condition on CB and CFB papers for processing over press and finishing equipment. Too much pressure, tension, etc., can cause capsular damage which effects a "blushing" on the CF side of the paper, which in turn can cause loss of image. There are also strict handling procedures which must be followed in order to prevent capsular damage in storage, and preparatory handling of roll stocks of the paper must be carefully carried out before the actual manufacturing process. During the printing operation of the papers of the carbonless impact transfer variety with which the present invention is concerned, premature and unintended rupture of the capsules affect the quality of the manifold sets, and U.S. Ser. Nos. 493,966 (now U.S. Pat. No. 4,000,087) and 505,415 (now abandoned), respectively filed July 29, 1974 and Sept. 12, 1974, commonly owned herewith, address themselves to these problems. In addition, in the development of chemically coated front and back carbonless impact transfer sheets problems of "ghosting" arise, which is an imaging of machine printed characters of CB or CFB sheets onto CF or CFB sheets when the two or more are in contact with one another, such as in files or binders.

Another area of concern in this carbonless transfer paper art is the intensity of the image produced as it relates to pressure sensitivity and further to the weight of the transfer papers. Generally, the carbonless transfer system utilizes a lightweight 12 pound base sheet with a specific CB coating weight to produce acceptable imaging on high numbered part forms, especially on high speed printers. To increase the image intensity, perhaps an additional amount of CB coating could be used and/or a lighter colored base sheet. However, the use of more CB coating may increase the pressure sensitivity problem and add to the cost of the product. And, the lighter colored base sheet could present problems in handling for manufacturing and forms handling.

SUMMARY OF THE INVENTION

It is therefore an object of the present invention to avoid many of the aforementioned drawbacks by providing a manifold set of carbonless recording sheets wherein only CF sheets of the set are printed thereby avoiding capsular damage to the CB sheets during the handling and processing operations.

In carrying out this object, provided is a manifold set of carbonless recording sheets wherein the set comprises at least a top, bottom and intermediate sheet with the bottom sheet having a coating on its top surface and the intermediate sheet having a coating on its bottom surface, the coatings comprising an initially colorless color-forming reactive component, with the reactive component of the coating of the bottom sheet being capable of reacting to produce a colored mark with a reactive component of the coating of the intermediate sheet upon coming in contact therewith so that, upon application of pressure to the set, the back and front coatings are forced into such reactive contact to thereby produce a colored mark. The top and bottom sheets are of the standard opaque paper materials, while the intermediate sheet is of a substantially translucent tissue material of the type found in any carbon transfer system except that, of course, the back coating thereon comprises a plurality of pressure rupturable microcapsules containing a color forming reactive component thereof with such microcapsules being rupturable upon application of pressure to the set. With such an arrangement any premature or unintentional capsular damage is substantially avoided since the intermediate tissue sheet is not printed and is therefore not run through the printer nor is it handled in storage similarly to the opaque coated sheets.

Alternatively, a single web may be coated on both sides with a dry coating of a solid co-reactant chemical for the precursor so as to form receiving sheets as the web is fan-folded in a zigzag arrangement. Tissues of the aforedescribed type having coated backs are interleaved between the folds of the web so that, upon application of pressure to the set, the back coatings of these intermediate sheets are forced into reactive contact with the front coatings of the next adjacent sheet to thereby produce colored marks.

BRIEF DESCRIPTION OF THE DRAWINGS

FIG. 1 is an expanded and enlarged, cross-sectional view of an embodiment of a manifolded set of carbonless recording sheets according to the present invention;

FIG. 2 is a schematic side elevational view in expanded form showing at a reduced scale another arrangement of a manifold set of carbonless copying sheets constructed of a single web which is fan folded and is interleaved with the coated tissue sheets; and FIG. 3 is a sectional view taken substantially along the line 3—3 of FIG. 2 of an expanded and enlarged showing of the FIG. 2 embodiment.

DETAILED DESCRIPTION OF THE INVENTION

Turning now to the drawings wherein like reference characters refer to like and corresponding parts throughout the several views, the manifolded set of carbonless recording sheets is generally designated 10 in FIG. 1 and includes at least a top sheet 11 of opaque paper material typically found in any set of business forms. Sheet 11 is shown in FIG. 1 as completely uncoated, although it may have a top coating thereon similar to other sheets in the set as to be more fully described hereinafter.

The set further includes a bottom sheet 12 of opaque paper material similar to that of sheet 11, with intermediate sheets 13, 14 and 15 lying between the top and bottom sheets. Bottom sheet 12 and intermediate sheet 14 are coated on their respective front surfaces with a coating 16, while sheets 13 and 15 are coated on their respective back surfaces with a coating 17. Each of the sheets shown in FIG. 1 are disposed to overlie one another with the back and front coatings therethroughout normally in contact with one another in the manifolded set although such sheets are shown as being vertically spaced in FIG. 1 in the interest of clarity. Each of the coatings 16 and 17 includes a color-forming reactive material, and the reactive material in each of the back coatings 17 is capable of reacting with a reactive material in each of front coatings 16, when pressed thereagainst, to produce a colored mark in a manner to be more fully described hereinafter.

Although three intermediate sheets are shown in FIG. 1, set 10 may nevertheless have additional intermediate sheets and as few as one intermediate sheet such as 13 or 15 with the single bottom sheet such as 12 or 14 without departing from the principle of the present invention.

Both coatings 16 and 17 comprise an initially colorless color-forming reactive component, and the reactive component of coatings 16 are capable of reacting to produce a colored mark with a reactive component of coatings 17 upon coming in contact therewith. Therefore, when coatings 16 and 17 are forced into reactive contact with one another, a colored mark is produced.

FIG. 1 illustrates the manner in which images are transferred onto a surface of sheets 14 and 12 underlying top sheet 11 as pressure is applied thereto in the direction of arrow 18. Coatings 17 preferably comprise tiny rupturable microscopic capsules having liquid fill therein, such fill comprising a reactive component thereof. The microcapsules are illustrated by small circles so that, when the capsules in coatings 17 are ruptured, by the application of pressure by stylus or machine key to the upper surface of sheet 11, as shown by arrow 18, mark 19 may immediately be impressed upon top sheet 11 of the set and corresponding marks 21 are formed on the upper surfaces of sheets 14 and 12 as the fill from coatings 17 of sheets 13 and 15 spills out of these ruptured capsules to contact and co-react with the reactive component of the reaction system contained in coatings 16. Naturally, since no coatings appear on adjacent surfaces of sheets 11 and 13 and on sheets 14 and 15, no imaging of mark 19 is left on the surfaces.

Sheet 14 is of the same opaque paper material as sheets 11 and 12, i.e., of any standard variety writing paper or business form. Sheets 13 and 15, however, are generally of translucent tissue material as commonly used in carbon paper transfer sets used in the transfer of images from an overlain sheet to an underlying one. Such tissue material, as is well known is typically of less thickness than that of opaque sheets 11, 12 and 14.

In FIGS. 1 and 3, the encapsulated first reactive component of the reactive system is illustrated as a series of small circles containing a plus mark ⊕ and the second reactive component of the reaction system is illustrated as a series of plus marks (+).

In another embodiment of the invention, a manifolded set of carbonless transfer sheets is generally designated 21 in FIG. 2 and comprises a single web 22 which is fan-folded into a zigzag pack schematically illustrated in FIG. 2 with the folds of the pack shown vertically spaced for the sake of clarity. Typically, spaced transverse lines of weakening 23 are provided along the web so as to effect successive folds of the web. Transfer sheets such as 13, similar to those shown in FIG. 1, are interleaved between the folds as in the manner illustrated in FIG. 2. Only five sheets of the set are shown in FIG. 3 for the purpose of illustration, although a minimum of three sheets may be used in carrying out the invention in accordance with the FIG. 2 embodiment. The sheets are shown vertically spaced in FIG. 3 for the sake of clarity although they are normally in contact with one another when in use. And, top and intermediate sheets 24 and 25 are interconnected along fold line 23, while intermediate sheet 25 and bottom sheet 26 are interconnected along fold line **23*a***.

Both top and bottom surfaces of web 22, and consequently both top and bottom surfaces of the folded sheets which comprise the web, are coated as at 16 with the coating having a reactive material capable of reacting with a reactive material in back coating 17, when pressed thereagainst, to produce a colored mark similarly as described for the FIG. 1 embodiment. Hence, when the capsules in coating 17 are ruptured as by the pressure by stylus or machine key to the upper surface of sheet 24, as indicated by arrow 27 in FIG. 3, a mark 28 may immediately be impressed on sheet 24 of the set and corresponding marks 29 are formed on the upper surfaces of sheets 25 and 26 as the fill from coatings 17 of sheets 13 spills out of these ruptured capsules to contact and co-react with the second reactive component of the system. As described in U.S. Application Ser. No. 561,623, U.S. Pat. No. 3,981,523 commonly owned herewith, the precursors useful in connection with carbonless copying systems are mentioned in U.S. Pat. No. 3,455,721. These materials are capable of reacting with a CF coating containing an acidic material such as the acid-leached bentonite-type clay disclosed in commonly owned U.S. Application Ser. No. 125,075, the entirety of which is hereby specifically incorporated by reference, or the acid-reactant organic polymeric material disclosed in the aforementioned U.S. Pat. No. 3,455,721. The '075 application, filed Mar. 17, 1971, was abandoned in favor of Continuation-In-Part Application Ser. No. 357,261, filed Aug. 4, 1973, and abandoned in favor of Continuation Application Ser. No. 555,742, filed Mar. 6, 1975, and now U.S. Pat. No. 3,963,852. There are a large number of patents which relate to initially colorless color procursors useful in connection with carbonless copying systems, although the present invention does not rely on the precise identity or nature of the reactants utilized except that at least one system of co-reactants is required for each of the two disclosed embodiments.

The reaction system usable for the present invention may be the same as either the first or the second initially colorless reaction systems disclosed in U.S. Application Ser. No. 561,623, filed Mar. 24, 1975, U.S. Pat. No. 3,981,523 the disclosure of which is specifically incorporated herein by reference. As set forth therein, any of the materials may be utilized which are disclosed in the aforementioned U.S. Pat. No. 3,455,721 and which are capable of undergoing an acid-base type reaction with an acidic material. Also operable in connection with the system are the spirodipyran compounds disclosed in U.S. Pat. No. 3,293,060. Particularly useful color precursors are disclosed in U.S. Pat. Nos. 3,193,404; 3,278,327 and 3,377,185. These color precursors as well as those disclosed in the U.S. Pat. No. 3,293,060 and in the U.S. Pat. No. 3,455,721 are initially colorless and are capable of becoming highly colored when brought into contact with an acidic material such as acid activated bentonite clay or an acid-reacting polymeric material, or the like. Similarly as in the aforementioned 3,987,523 commonly owned patent, the above-mentioned disclosures pertaining to the color precursors are specifically incorporated herein by reference, although there are any number of similar color precursors capable of undergoing a reaction with an acid coating to produce a color which are usable herewith.

The color precursor materials as disclosed in these patents may be dissolved in a solvent and the solution may be encapsulated as taught in the aforementioned U.S. Pat. Nos. 3,016,308 and 2,712,507. Other processes for encapsulating color precursors are disclosed in U.S. Pat. Nos. 3,429,827 and 3,578,605. It should be pointed out, however, that the exact nature of the capsule itself is not critical so long as the same is capable of containing the color precursor with the capsules capable of being ruptured upon impact in accordance with conventional carbonless copying procedures. Solvents which are useful in connection with dissolving color precursors include chlorinated biphenyls, vegetable oils (caster oil, coconut oil, cottonseed oil, etc.), esters (dibutyl adipate, dibutyl phthalate, butyl bnzyl adipate, bnzyl octyl adipate, tricresyl phosphate, trioctyl phosphate, etc.), petroleum derivatives (petroleum spirits, kerosene, mineral oils, etc.), aeromatic solvents (benzene, toluene, etc.), silicone oils, or any combination of the foregoing. Particularly useful are the alkylated naphthalene solvents disclosed in U.S. Pat. No. 3,806,463.

With regard to the acidic coatings capable of converting the color precursors into their highly colored form, particular reference is made to the clay coatings disclosed in the aforementioned U.S. Pat. No. 3,963,852, commonly owned herewith.

In each of the above-mentioned color-forming systems, it is conventional for the color precursors to be contained in pressure rupturable microcapsules which are coated on the backs of the sheets of carbonless copying manifolded sets. Also, the acidic coatings are normally coated on the fronts of the sheets with the color precursor material in a solvent therefor being transferred from an adjacent back coating to the acidic layer front coating upon rupture of the adjacent capsules which contain the color precursor material.

The second initially colorless reaction system described in the aforementioned U.S. Pat. No. 3,981,523 may be alternatively used for the aforedescribed reactive system in the present invention.

While in storage and before printing, the coated front sheets of the FIG. 1 embodiment such as 12 and 14, and sheet 11 whether or not coated with a coating 16, may be in manifolded form and subjected to the normal pressures of stacked manifolded forms without the danger of capsular damage resulting since no CF sheet ever comes into contact with CB sheets or with CFB sheets in such condition. The CB coated tissue sheets 13 and 15 are stored independently of the CF sheets and are not interleaved between CF sheets in the set as in FIG. 1 until the printing operation of the CF sheets is completed. Any "blushing" or "ghosting", which is an imaging of machine printed characters of CB or CFB sheets onto CF or CFB sheets when in contact with one another, capable of causing loss of image, is therefore substantially avoided. Such potential image loss is likewise avoided when the printed CF sheets are placed in files or binders after the printing operations since the CB tissue sheets are removed before binding or filing the CF sheets, the CB tissue sheets not being printed as in prior art arrangements.

During the printing process, only sheets 11, 14 and 12 are printed so that, as the sheets move over the printing press rollers and are subjected to various tensions, problems of capsular damage are avoided because of the absence of any micro-encapsulated CB sheets being processed through the printer. Such capsular damage is likewise avoided as the CF sheets are run through various types of finishing equipment.

At the termination of the printing and finishing operations, the CB tissue sheets are inserted into the sets such as 10 shown in FIG. 1 between the opaque CF sheets and the sets are therefore made available for ultimate use. And, depending on the uses to which the sets are placed, the CB tissues can be either disposed of or reclaimed for further use while completely avoiding any problems of smudging as with the use of carbon coated tissue paper. Also, the CB tissue papers usable in the manifold sets according to the invention may effect an improved image intensity without the need for any additional coating on the backs thereof. The CB tissues can also be combined with any weight paper that is CF coated, for higher numbers of parts or heavier CF coated stocks, if forms handling becomes a problem. And the CB tissues may be pattern printed with the microencapsulated liquid thereby effecting imaging block-out features which eliminate the need for desensitizing inks.

Another advantageous use of CB tissue papers in an arrangement according to the invention may be found in those forms constructions relying on the use of lightweight tissue transfer paper to maintain the integrity of the particular forms construction and to render it useful for the particular purpose intended. For example, tissue transfer paper is utilized in the manifolding assemblies disclosed in commonly owned U.S. Pat. No. 2,907,585 since the heavier opaque sheets having coated backs or coated fronts and backs would otherwise result in an increased thickness of the manifold assembly and may even interfere with the flexibility in movement between the record assembly parts to which this particular invention is directed. Another example of the convenient use of CB tissue papers is in the fan-folded forms constructions illustrated in FIGS. 2 and 3 of the present drawings. The lightweight and thinner interleaved CB tissue transfer papers renders the fan-folded assembly less bulky and easier to use and handle than before as when the CB opaques or the CFB opaques were only made available.

Obviously, many other modifications and variations of the present invention are made possible in the light of the above teachings. It is therefore to be understood that within the scope of the appended claims the invention may be practiced otherwise than as specifically described.

What is claimed is:

1. A manifold set of carbonless recording sheets, comprising:

at least three superimposed plies forming the set;

one of said plies comprising a first sheet of an opaque material of a first predetermined thickness;

another of said plies comprising an intermediate sheet of tissue material of a second predetermined thickness and underlying said first sheet;

still another of said plies comprising a second sheet of an opaque material of a third predetermined thickness and underlying said intermediate sheet;

said intermediate sheet on only a back surface thereof and said second sheet on only a front surface thereof having coatings each comprising an initially colorless color forming reactive component;

the coating on said intermediate sheet comprising a plurality of pressure rupturable microcapsules containing the color forming reactive component thereof, said microcapsules being rupturable upon application of pressure to the set;

the reactive component of the coating of said intermediate sheet being in a transferable form such that the same will be transferred from said intermediate sheet to said second sheet in response to application of pressure to the set and being capable of reacting to produce a colored mark with the reactive component of the coating of said second sheet upon coming into reactive contact therewith;

said reactive component of the coating of said second sheet being in a non-transferable form such that the produced mark is presented on said second sheet;

said first sheet having a back surface with no coating thereon comprising said initially colorless color forming reactive component, and said tissue material is unavailable for accepting printing thereon, whereby said tissue material is available only for effecting a colored mark onto said front surface of said second sheet, after which said tissue material is discardable from the set; and said second predetermined thickness of said intermediate sheet being less than said first predetermined thickness and less than said third predetermined thickness of said first and second sheets, respectively, whereby said tissue material effects a reduction in thickness of the set as compared to said second predetermined thickness being at least equal to either of said first and third thicknesses.

2. A manifold set of carbonless recording sheets comprising:

at least three superimposed plies of first, intermediate and second sheets forming the set;

said first and second sheets being of an opaque material of a first predetermined thickness, and said intermediate sheet being of a tissue material disposed between said first and second sheets and being of a second predetermined thickness less than said first predetermined thickness;

said intermediate sheet having a coating on only a back surface thereof, and said second sheet having a coating on only a front surface thereof, said coatings each comprising an initially colorless color forming reactive component;

the coating on said intermediate sheet comprising a plurality of pressure rupturable microcapsules containing the color forming reactive component thereof, said microcapsules being rupturable upon application of pressure to the set;

the reactive component of the coating of said second sheet being in a non-transferable form and being capable of reacting to produce a colored mark with the reactive component of the coating of said intermediate sheet upon said intermediate and said second sheets being brought into reactive contact with one another;

said reactive component of the coating of said intermediate sheet being in a transferable form such that the same is transferred from said intermediate sheet to said second sheet in response to application of pressure to the set;

said first sheet having a back surface with no coating thereon comprising said initially colorless color forming reactive component, and said tissue material is unavailable for accepting printing thereon, whereby said tissue material is available only for effecting a colored mark onto said front surface of said second sheet, after which said tissue material is discardable from the set; and whereby said tissue material of said second predetermined thickness effects a reduction of thickness of the set as compared to said first and second thicknesses being equal.

* * * * *